US005955247A

United States Patent [19]

Uchihiro

[11] Patent Number: 5,955,247

[45] Date of Patent: Sep. 21, 1999

[54] METHOD FOR PROCESSING SILVER HALIDE PHOTOGRAPHIC LIGHT-SENSITIVE MATERIAL

[75] Inventor: Shinji Uchihiro, Hino, Japan

[73] Assignee: Konica Corporation, Japan

[21] Appl. No.: 09/111,167

[22] Filed: Jul. 7, 1998

[30] Foreign Application Priority Data

Jul. 9, 1997 [JP] Japan ..... 9-183840

[51] Int. Cl.[6] ..... G03C 5/38

[52] U.S. Cl. ..... 430/419; 430/264; 430/456; 430/458; 430/465

[58] Field of Search ..... 430/264, 419, 430/456, 458, 465

[56] References Cited

U.S. PATENT DOCUMENTS

| | | | |
|---|---|---|---|
| 3,867,151 | 2/1975 | Katz | 430/419 |
| 5,587,277 | 12/1996 | Yamashita et al. | 430/458 |
| 5,851,742 | 12/1998 | Nishio | 430/465 |

FOREIGN PATENT DOCUMENTS

| | | |
|---|---|---|
| 0774687 | 5/1997 | European Pat. Off. . |
| 2112954 | 7/1983 | United Kingdom . |

*Primary Examiner*—Hoa Van Le

*Attorney, Agent, or Firm*—Jordan B. Bierman; Bierman, Muserlian and Lucas

[57] ABSTRACT

A method for processing a black-and-white silver halide photographic light-sensitive material by a monobath processing method. The processing method comprises the steps of providing a solid composition which comprises a first part containing a developing agent represented by Formula A and optionally a dihydroxybenzene compound, and a second part containing a fixing agent, and both of the first part and the second part are each coated with a coating material, dissolving the solid composition into water in order to make a monobath processing solution, processing a silver halide photographic light-sensitive material comprising a compound represented by Formula H with the monobath processing solution, Formula(A)

Formula(H)

6 Claims, 1 Drawing Sheet

METHOD FOR PROCESSING SILVER HALIDE PHOTOGRAPHIC LIGHT-SENSITIVE MATERIAL

FIELD OF THE INVENTION

This invention relates to a method for processing a black-and-white silver halide photographic light-sensitive material, particularly relates to a method for processing a black-and-white silver halide photographic light-sensitive material in which the development and fixing processes are performed by the same solution.

BACKGROUND OF THE INVENTION

Silver halide photographic light-sensitive material, hereinafter simply referred to light-sensitive material, is treated by processes of developing, fixing, washing and stabilizing after imagewise exposure to light. The processing is performed by an automatic processor, and a replenishing system is widely applied in which a replenishing solution is replenished to maintain the activity of the processing solution. The purpose of the replenishment by the replenishing solution is to dilute substances dissolved out from the light-sensitive material, to compensate of evaporated amount and to replenish the consumed components.

Other than the foregoing processing, a processing method so called a monobath processing is applied in which the developing and fixing are performed in the same solution.

Although the monobath processing by suing an usual monobath processing solution has such advantages that one processing tank can be reduced compared to the usual two-bath processing and the automatic processor can be made compact, the method causes a problem that the fogging is increased when the monobath processing is carried out by a processing solution using hydroquinone as a principal component.

In a case of the use of a liquid processing composition, a troublesome operation for preparation of the processing solution and a trouble accompanied with the replenishment of the liquid composition cannot be reduced and the working for the operation is not lightened so much even when the monobath processing is applied.

Moreover, it is a problem that the degradation of the replenishing solution is considerably serious compare to that in the two-bath processing. Further, regarding the photographic properties, the mono-bath processing has a serious problems such as that the maximum density and the linearity of the gradation are considerably degraded. The solution of such the problems has been strongly demanded.

SUMMARY OF THE INVENTION

The object of the invention is to provide a monobath processing method for a black-and-white silver halide photographic light-sensitive material using a solid processing composition in which a troublesome operation to prepare the processing solution is not required and the degradation in the maximum density and linearity is prevented.

The object of the invention can be attained by a method for processing a black-and-white silver halide photographic light-sensitive material comprising the steps of providing a solid composition which comprises a first partial composition containing a developing agent represented by Formula A and optionally a dihydroxybenzene compound, and a second partial composition containing a fixing agent, and both of the first and the second partial composition are each coated with a coating material, dissolving the solid composition into water in order to make a monobath processing solution, processing a silver halide photographic light-sensitive material comprising a compound represented by Formula H with the monobath processing solution, Formula A

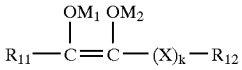

wherein, $R_{11}$ and $_{12}$ are each an alkyl group, an alkokyl group, an amino group, or an alkylthio group, and $R_{11}$ and $_{12}$ may be linked with each other to form a ring, k is 0 or 1, and X is —OC— or —CS when k is 1, and $M_1$ and $M_2$ are each a hydrogen atom or an alkali metal atom, Formula H

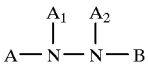

wherein, A is an aliphatic group, an aromatic group or a heterocyclic group, B is an acyl group, an alkylsulfonyl group, an arylsulfonyl group, an alkylsulfinyl group, an arylsulfinyl group, a carbamoyl group, an alkoxycarbonyl group, an aryloxycarbonyl group, a sulfamoyl group, a sulfinamoyl group, an alkoxysulfonyl group, thioacyl group, a thiocarbamoyl group, an oxaryl group, or a heterocyclic group, and $A_1$ and $A_2$ are each a hydrogen atom, or one of them is a hydrogen atom and the other one is a acyl group, a sulfonyl group or an oxaryl group.

DETAILED DESCRIPTION OF THE INVENTION

Figure 1:
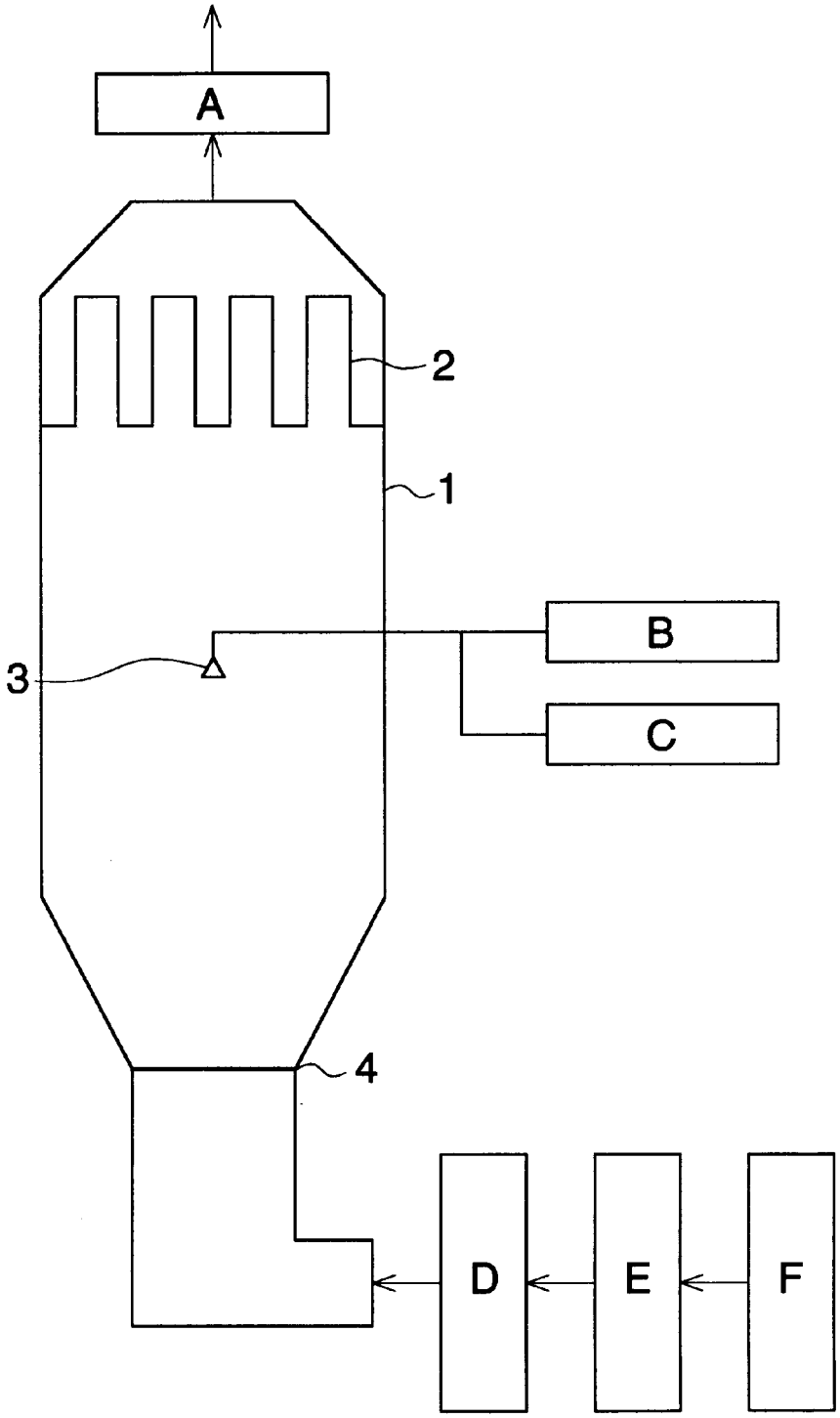
FIG. 1 shows a schematic drawing of an example of fluidizing layer granulating apparatus.

In the processing of the invention, the black-and-white silver halide photographic material to be processed contains a hydrazine compound represented by Formula H, and a monobath processing is applied. The processing composition containing an ascorbic acid type developing agent represented by Formula A and a fixing agent, is prepared in a form of a solidified processing composition. A developing-fixing solution, or a monobath processing solution, can be prepared by only dissolving the solid processing composition by water at the using time, and the processing solution can be used in a fresh and highly active condition by replenishing the solid processing composition corresponding to the processed amount of the light-sensitive material. Consequently, a black-and-white image having a high density and good gradation can be stably obtained without increasing in fogging and variation of the maximum density.

The solid processing composition to be used in the processing method of the invention comprises at least two partial compositions, a first partial composition and a second partial composition. The first partial composition comprises a developing agent represented by Formula A and optionally a dihydroxybenzene compound. The second partial composition comprises a fixing agent. Each of these partial compositions is respectively coated with a coating material. It is preferred that the partial compositions are each in a form of granule. The two partial compositions are uniformly mixed and pressed into the solid composition. The solid composition is preferably in a form of a tablet.

The first partial composition contains a compound represented by the foregoing Formula A as a developing agent. The compound represented by Formula A is ascorbic acid or its derivatives. Among them, a developing agent represented by the following Formula A-a is preferred, in which $R_{11}$ and $R_{12}$ of Formula A form a ring by liking with each other.

Formula A-a

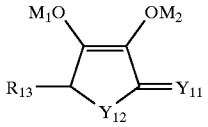

In the formula, $R_{13}$ is a hydrogen atom, or an alkyl group, an aryl group, an amino group, an alkoxyl group, each of which may have a substituent, a sulfo group, a carboxyl group, an amido group, or a sulfonamido group, $Y_{11}$ is O, S or $NR_{14}$. $R_{14}$ is an alkyl group or an aryl group each may have a substituent.

Concrete examples of the compound represented by Formula A or A-a are shown below. The compound is not limited thereto.

| Formula (A) | | | | | |
|---|---|---|---|---|---|
| Compound No. | X | $R_{11}$ | $R_{12}$ | $M_1$ | $M_2$ |
| A-1 | — (k = 0) | $HOCH_2$—CH(OH)—CH(OH)— | —OH | H | H |
| A-2 | — (k = 0) | $CH_3$—CH(OH)—CH(OH)— | —OH | H | H |
| A-3 | — (k = 0) | $HOCH_2$—CH(OH)—CH(OH)— | —$CH_3$ | H | H |
| A-4 | — (k = 0) | $CH_3$—CH(OH)—CH(OH)— | —$CH_3$ | H | H |
| A-5 | —C(=O)— (k = 1) | $HOCH_2$—CH(OH)—CH(OH)— | —OH | H | H |
| A-6 | —C(=O)— (k = 1) | $CH_3$—CH(OH)—CH(OH)— | —OH | H | H |
| A-7 | —C(=S)— (k = 1) | $HOCH_2$—CH(OH)—CH(OH)— | —OH | H | H |
| A-8 | —C(=S)— (k = 1) | $CH_3$—CH(OH)—CH(OH)— | —OH | H | H |
| A-9 | —C(=O)— (k = 1) | HO—$CH_2$— | —OH | H | H |
| A-10 | —C(=O)— (k = 1) | HO—$CH_2$— | —$CH_3$ | H | H |
| A-11 | —C(=O)— (k = 1) | HO—$CH_2$— | —$C_2H_5$ | H | H |

-continued

| | | | | | |
|---|---|---|---|---|---|
| A-12 | $-\overset{\overset{O}{\|\|}}{C}-$ (k = 1) | $HO-CH_2-$ | $-CH_2CH_2OH$ | H | H |
| A-13 | — (k = 0) | $HOCH_2-\underset{\underset{OH}{\|}}{CH}-\underset{\underset{OH}{\|}}{CH}-$ | —OH | H | Na |
| A-14 | — (k = 0) | $CH_3-\underset{\underset{OH}{\|}}{CH}-\underset{\underset{OH}{\|}}{CH}-$ | —OH | H | Na |
| A-15 | — (k = 0) | $HOCH_2-\underset{\underset{OH}{\|}}{CH}-\underset{\underset{OH}{\|}}{CH}-$ | $-CH_3$ | H | Na |
| A-16 | — (k = 0) | $CH_3-\underset{\underset{OH}{\|}}{CH}-\underset{\underset{OH}{\|}}{CH}-$ | $-CH_3$ | H | Na |
| A-17 | $-\overset{\overset{O}{\|\|}}{C}-$ (k = 1) | $HOCH_2-\underset{\underset{OH}{\|}}{CH}-\underset{\underset{OH}{\|}}{CH}-$ | —OH | H | Na |
| A-18 | $-\overset{\overset{O}{\|\|}}{C}-$ (k = 1) | $CH_3-\underset{\underset{OH}{\|}}{CH}-\underset{\underset{OH}{\|}}{CH}-$ | —OH | H | Na |
| A-19 | $-\overset{\overset{S}{\|\|}}{C}-$ (k = 1) | $HOCH_2-\underset{\underset{OH}{\|}}{CH}-\underset{\underset{OH}{\|}}{CH}-$ | —OH | H | Na |
| A-20 | $-\overset{\overset{S}{\|\|}}{C}-$ (k = 1) | $CH_3-\underset{\underset{OH}{\|}}{CH}-\underset{\underset{OH}{\|}}{CH}-$ | —OH | H | Na |
| A-21 | $-\overset{\overset{O}{\|\|}}{C}-$ (k = 1) | $HOCH_2-\underset{\underset{OH}{\|}}{CH}-\underset{\underset{OH}{\|}}{CH}-$ | —OH | Na | H |
| A-22 | $-\overset{\overset{O}{\|\|}}{C}-$ (k = 1) | $CH_3-\underset{\underset{OH}{\|}}{CH}-\underset{\underset{OH}{\|}}{CH}-$ | —OH | Na | H |
| A-23 | $-\overset{\overset{S}{\|\|}}{C}-$ (k = 1) | $HOCH_2-\underset{\underset{OH}{\|}}{CH}-\underset{\underset{OH}{\|}}{CH}-$ | —OH | Na | H |
| A-24 | $-\overset{\overset{S}{\|\|}}{C}-$ (k = 1) | $CH_3-\underset{\underset{OH}{\|}}{CH}-\underset{\underset{OH}{\|}}{CH}-$ | —OH | Na | H |

Formula (A-a)

| Compound No. | $Y_{11}$ | $Y_{12}$ | $R_{13}$ | $M_1$ | $M_2$ |
|---|---|---|---|---|---|
| A-25 | O | O | H | H | H |
| A-26 | O | O | $CH_3-$ | H | H |
| A-27 | O | O | $\underset{\underset{OH}{\|}}{CH_2}-$ | H | H |
| A-28 | O | O | $CH_3-\underset{\underset{OH}{\|}}{CH}-$ | H | H |
| A-29 | O | O | $HOCH_2-\underset{\underset{OH}{\|}}{CH}-$ | H | H |

-continued

| | | | | | |
|---|---|---|---|---|---|
| A-30 | O | O | $ClCH_2-CH(OH)-$ | H | H |
| A-31 | O | O | $HOOCCH_2-CH(OH)-$ | H | H |
| A-32 | S | O | H | H | H |
| A-33 | S | O | $CH_3-CH(OH)-$ | H | H |
| A-34 | S | O | $HOCH_2-CH(OH)-$ | H | H |
| A-35 | O | $NCH_3$ | H | H | H |
| A-36 | O | NH | $HOCH_2-CH(OH)-$ | H | H |
| A-37 | O | S | H | H | H |
| A-38 | O | S | $HOCH_2-CH(OH)-$ | H | H |
| A-39 | O | S | $CH_3-CH(OH)-$ | H | H |
| A-40 | S | S | H | H | H |
| A-41 | S | S | $HOCH_2-CH(OH)-$ | H | H |
| A-42 | S | S | H | H | H |
| A-43 | O | O | $CH_3-CH(OH)-$ | H | Na |
| A-44 | O | O | $HOCH_2-CH(OH)-$ | H | Na |
| A-45 | O | O | $ClCH_2-CH(OH)-$ | H | Na |
| A-46 | O | O | $HOOCCH_2-CH(OH)-$ | H | Na |
| A-47 | S | O | H | H | N |
| A-48 | S | O | $CH_3-CH(OH)-$ | H | Na |
| A-49 | S | O | $HOCH_2-CH(OH)-$ | H | H |
| A-50 | O | O | $CH_3-CH(OH)-$ | Na | H |

-continued

| | | | | | |
|---|---|---|---|---|---|
| A-51 | O | O | $HOCH_2-CH(OH)-$ | Na | H |
| A-52 | O | O | $ClCH_2-CH(OH)-$ | Na | H |
| A-53 | O | O | $HOOCCH_2-CH(OH)-$ | Na | H |
| A-54 | S | O | H | Na | H |
| A-55 | S | O | $CH_3-CH(OH)-$ | Na | H |
| A-56 | S | O | $HOCH_2-CH(OH)-$ | Na | H |

In the first partial composition of the solid processing composition according to the invention, a hydroxybenzene type developing agent optionally may be used together with the developing agent represented by Formula A. The hydroxybenzene type developing agent is one represented by the following Formula I, II or III.

Formula I

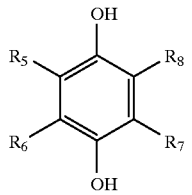

Formula II

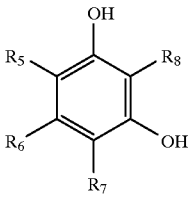

Formula III

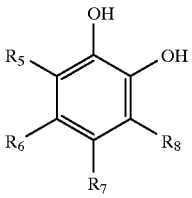

In the formula, $R_5$, $R_6$, $R_7$ and $R_8$ are each independently a hydrogen atom, an alkyl group, an aryl group, a carboxyl group, a halogen atom or a sulfo group.

The dihydroxybenzene usable in the invention includes hydroquinone, chlorohydroquinone, isopropylhydroquinone, methylhysroquinone and hydroquinonesulfonic acid, and hydroquinone is particularly preferred.

The molar ratio (HQ/A) of dihydroxybenzene type developing agent (HQ) to the compound represented by Formula A, (A) is from 0 to 1000, preferably from 0 to 100, more preferably from 0 to 30.

The first partial composition preferably contains an alkaline agent together with the developing agent.

The second partial composition, contains a fixing agent. As the fixing agent a thiosulfate or a thiocyanate usually used as the fixing agent is useful.

It is preferred that each of the first and seconds partial compositions is made in a form of granules. The granules of the partial compositions are each coated with a coating material.

For the granulating method in the invention, a tumbling granulation method, a extrusion granulation method, a jet-layer granulation method, a fluidized layer granulation method, a crush granulation method, a sirring granulation method and a compression granulation method are usable. In the invention, the sugar or water-soluble high molecular weight compound can be coated on the granule prepared by an optional method by a coating method such as a pan coating method, a tumbling coating method, a fluidized layer coating method.

The granulation and coating of the composition can be continuously performed in the same vessel by using a fluidized layer granulation apparatus or a tumbling layer granulation apparatus. Such the method shows a high production efficiency and is preferable from the viewpoint of the effect of the invention. The method using the fluidized layer granulation apparatus is described below.

The production method of the composition is described below according to FIG. 1 which shows a scheme of an example of fluidized layer granulation apparatus. Air sucked by an air fan F is cleared through an air supplying filter E, and is heated by a prescribed temperature by a heat exchanger D. Heated air is supplied into the core of the apparatus 1 through a current regulation plate 4. The hot air suspends powder particles to contact the power particles with liquid droplets atomized by a compressed air B, a liquid transporting device C and a atomizing device 3, and functions as a heat source to dry the powder in the fluidized layer wetted with the droplets. Fine particles scattered to the upper potion of the apparatus are caught by a dust collection filter 2 and returned to the fluidized layer. Filtered air is exhausted outside by an exhaust fan A.

A pressure nozzle method, a rotating disk method, and a two-fluid nozzle method are useful to atomize the liquid to the fluid powder particles. In the pressure nozzle method, the liquid is flowed out at a high speed in air by applying a pressure and atomized to fine droplets by the relative speed difference of the liquid from that of air. In the rotating disk method, the liquid is poured to the center of a disk rotating at a high speed, and atomized at the circumference portion of the disk by the centrifugal force. In the two-fluid nozzle method. The liquid is dispersed to fine droplets by applying a high speed current of a compressible gas such as air, nitrogen or steam. The high speed current of such the gas can be obtained at a relatively low pressure.

Among these methods, the method to atomize the solution of the component in a little amount by the two-fluid nozzle is preferably used since the droplets is rapidly dried and the effect of the invention is enhanced. In such the case, the volume ratio of air to the solution sent out from the nozzle in an unit of period is preferably from 100 to 10,000, more preferably from 1,000 to 5,000.

A fluidized layer granulation apparatus available on the market such as Multiprex series, GPCG series and WST/WSG series manufactured by Pawrex Co., Ltd., New Malmerizer series manufactured by Fuji Powdal Co., Ltd., Mixgrard series manufactured by Ookahara Seisakusyo Co., Ltd., and Spiral flow series and Flow coater series manufactured by Freund Co., Ltd., is useful.

As the coating material for coating the granules of the partial composition, a sugar and a water-soluble high molecular weight compound preferably are preferred. The preferable coating material include as sugaralcohol, a monosaccharide such as glucose and galactose, a disaccharide such as maltose, sucrose and lactose, a polysaccharide, a polyalkylene glycol, a polyvinyl alcohol, a polyvinylpyrrolidone, a polyvinylacetal, a polyvinyl acetate, an aminoalkyl methacrylate copolymer, a methacrylic acid-methacrylate copolymer, a methacrylic acid-acrylate copolymer and a vinylpolymer having a betaine structure. Among them, a sugaralcohol, a polysaccharide and a polyalkylene glycol represented by Formula G.

Formula G $$HO-(CH_2CH_2O)_l-(CH_2CH_2CH_2O)_m-(CH_2(CH_3)CHO)_n-H$$

In the formula, l, m and n are each an integer from 0 to 1,000 and the total of l, m and n is not less than 10.

As preferable sugaralcohol, the followings are cited: tholeitol, erythritol, arabitol, ribitol, xtlitol, sorbitol, mannitol, iditol, talitol, galactitol, and allodulcitol.

Pullulan, methyl cellulose, ethyl cellulose, hydroxypropyl cellulose, hydroxyoropylmethyl cellulose, cellulose acetate-phthalate, hydroxypropylmethyl cellulose phthalate, hydroxypropylmethyl cellulose succinate, carboxymethyl cellulose, a dexrin, a cyclodextrin and a decomposition product of starch are preferable as the polysaccharide. Pineflow, and Pinedex, manufactured by Matsutani Kagaku, are particularly preferable as the decomposition product of starch.

Preferable examples of the compound represented by Formula G are as follows.

(1)

$$HO-(CH_2CH_2O)_l-H$$

(2)

$$HO-(CH_2CH_2CH_2O)_m-H$$

-continued (3)

$$HO-(CH_2-\underset{\underset{CH_3}{|}}{C}HO)_n-H$$

(4)

$$HO-(CH_2CH_2O)_l-(CH_2CH_2CH_2O)_m-H$$

(5)

$$HO-(CH_2CH_2O)_l-(CH_2-\underset{\underset{CH_3}{|}}{C}HO)_n-H$$

(6)

$$HO-(CH_2CH_2CH_2O)_m-(CH_2-\underset{\underset{CH_3}{|}}{C}HO)_n-H$$

In the above-mentioned formulas, l, m and n are synonyms for l, m and n in Formula G, respectively.

Among the above-mentioned, a polyethylene glycol shown as exemplified compound 1. The average molecular weight of that is preferably from 1,000 to 10,000. Concrete example of that includes polyethylene glycol #2000, #4000 and #6000, manufactured by Kanto Kagaku Co. Ltd.

The amount the sugar or water-soluble high molecular weight compound is preferably from 0.2% to 20% by weight to the weight of the granules of each of the parts of the composition. The size distribution of the granules of each of the parts is preferably that the weight of granules having a diameter of not more than 149 $\mu$m accounts for not more than 20% by weight of the weight of the whole granules of the part, and the weight of granules having a diameter of not less than 1,000 $\mu$m is account for not more than 20% of the weight of the whole granules of the part. In the invention, the diameter of the granule is determined by a sifting method using sieves according to JIS standard. The weights of granules passed and those not passed through a sieve of 197 $\mu$m or 100 mesh, or a sieve of 1,000 $\mu$m or 16 mesh, are measured, respectively.

A solution of the sugar or water-soluble high molecular weight substance in a solvent is used as the liquid to be atomized for coating. The solvent is preferably water from the view point of the effect of the invention, a safeness and an environmental suitability. The concentration of the sugar or the water-soluble high molecular weight substance in the solvent is preferably from 1% to 70% by weight.

Granules of the first partial composition containing the compound represented by Formula A and granules of the second partial composition containing at least one kind of thiosulfate of thiocyanate are contained in the solid processing composition in the invention in an uniformly mixed state. A mixer available on the market is used to uniformly mix the two partatial compositions, and a cross-rotary mixer and a V-type mixer are preferable from the viewpoint of the effect of the invention. The solid composition may be formed in an optional shape such as solidifying granules, powders or crystals. The shape of the solid composition is preferably a tablet formed by compression. A single-punch tableting machine and a rotary tableting machine available on the market are useful. The pressure for tableting is preferably from 0.5 to 3 metric tons/cm$^2$. When the pressure is less than 0.5 metric tons/cm$^2$, fine powder tends to formed and when the pressure is more than 5 metric tons/cm$^2$, the storage ability and dissolved ability of the tablet are degraded.

In the processing of light-sensitive material, the processing solution is replenished by a replenishing solution in an amount in proportion to the processed area of light-sensitive material to satisfy the requirement of reducing the amount of the exhausted waste liquid. The amount of the replenishing solution is preferably not more than 250 ml/$m^2$.

The replenishing amount of the processing solution is the amount of the replenishing solution to be supplied. In concrete, when the mother liquid of monobath processing, solution or developing-fixing solution, is replenished by a solution the same as the mother solution, the replenishing amount is the amount of the replenishing solution. When the replenishing is performed by using a diluted solution of a concentrated monobath processing solution, the replenishing amount is the amount of sum of the amount of the concentrated solution and water. When the replenishing is performed by using a solution prepared by dissolving a solid composition by water, the replenishing amount is the amount of sum of the volume of the solid composition and that of water. When the replenishing is performed by a solid processing composition and water to be separately added, the replenishing amount is sum of the volume of the solid composition and water. In the case of the replenisher is added in a form of solid composition, it is preferable to describe the replenishing amount by the sum of the volume of the solid processing composition directly supplied to the processing tank of an automatic processor and the volume of replenishing water separately added. The developing-fixing replenishing solution may be a solution or a solid processing composition the same or different from the mother liquid of developing solution and the mother liquid charged in the tanks of the automatic processor.

In the case of solid processing composition, the amount of the composition to be supplied at once is preferably from 0.1 to 50 g. The photographic properties of processing is not influenced even when the solid processing composition in the amount of within the forgoing range is directly supplied to the processing tank of processor and slowly dissolved. Because, the solid composition is dissolved slowly, not so rapidly, and the dissolved amount of the composition is balanced with the consumed amount thereof by the processing even when a large amount of the solid composition is supplied at once. Thus stable photographic property can be obtained. It is found that the photographic property can also be stabled by replenishing water in an amount corresponding to dissolution of the composition. The processing solution is almost constantly maintained at the processing temperature. The balance of the supplying amount of the solid processing composition and the composition of the processing solution can be balanced since the dissolving speed of the solid composition is almost constant.

The temperatures of developing-fixing, washing and/or stabilizing are preferably within the range of from 10° C. to 50° C. These processes may be each controlled at deferent temperatures separately.

The black-and-white silver halide photographic light-sensitive material, hereinafter referred to the light-sensitive material, to be processed by the processing method of the invention comprises a support, and a silver halide emulsion layer and optionally a non-light-sensitive hydrophilic colloid layer provided on the support. The light-sensitive material contains a compound represented by the foregoing Formula H. The compound represented by Formula H is preferably contained in the silver halide emulsion layer or a non-light-sensitive hydrophilic colloid layer adjacent to the silver halide emulsion layer.

The hydrazine compound represented by Formula H is described below.

The aliphatic group represented by A in Formula H is preferably one having from 1 to 30 carbon atoms, particularly preferably a linear- or branched-chain or cyclic alkyl group, for example, methyl group, ethyl group, t-butyl group, octyl group, cyclohexyl and benzyl group, each of which may have a substituent such as an aryl group, an alkoxyl group, an aryloxy group, an alkylthio group, a sulfoxy group, a sulfonamido group, an acylamino group and an ureido group. An aromatic group represented by A is preferably a single or condensed aryl group, for example, a benzene ring or a naphthalene ring. The heterocyclic group represented by A is preferably a single or condensed heterocyclic ring containing at least one hetero atom selected from nitrogen, sulfur and oxygen, for example, a pyrrolidine ring, an imidazole ring, a tetrahydrofuran ring, a morpholine ring, a pyridine ring, a pyrimidine ring, a quinoline ring, a thiazole ring, a benzothiazole ring a thiophene ring and a furan ring. An aryl group and a heterocyclic group are particularly preferable as the group represented by A. The aryl group and heterocyclic group of A may have a substituent. The substituent in such the case includes the followings: an alkyl group preferably one having from 1 to 20 carbon atoms, an aralkyl group preferably single or condensed one having 1 to 3 carbon atoms in the alkyl moiety thereof, an alkoxyl group preferably one having from 1 to 20 carbon atoms in the alkyl moiety thereof, a substituted amino group preferably an amino group substituted by an alkylene group or an alkylidene group each having from 1 to 20 carbon atoms, an acylamino group preferably one having from 1 to 40 carbon atoms, a sulfonamido group preferably one having from 1 to 40 carbon atoms, a hydrazinocarbonyl-amino group preferably one having from 1 to 40 carbon atoms, a hydroxyl group, and a phosphonamido group preferably one having from 1 to 40 carbon atoms. It is preferred that the group represented by A contains a anti-diffusion group or a group accelerating absorption to silver halide. As the anti-diffusion group, a ballast group usually used in an immobile photographic additive such as a coupler is preferably used. As the ballast group, a photographically inactive group having 8 or more carbon atoms such as an alkyl group, an alkenyl group, an alkinyl group, an alkoxyl group, a phenyl group, a phenoxy group and an alkylphenoxy group. As the group accelerating absorption to silver halide, thiourea, a thiourethane group, a mercapto group, a thioether group, a thione group, a heterocyclic group, a thioamidoheterocyclic group, a mercaptoheterocyclic group, and a adsorbing groups described in JP O.P.I. No. 64-90439.

B in Formula H concretely represents an acyl group such as formyl group, acetyl group, a propionyl group, trifluoroacetyl group, phenoxyacetyl group, methylthioacetyl group, chloroacetyl group, benzoyl group, 2-hydroxymethylbenzoyl group and 4-chlorobenzoyl group, an alkylsulfonyl group such as methanesulfonyl group and 2-chloroethnaesulfonyl group, an arylsulfonyl group such as benzenesulfonyl group, an alkylsulfinyl group such as methanesulfinyl group, an arylsulfinyl group such as benzenesulfinyl group, a carbamoyl group such as methylcarbamoyl group and phenylcarbamoyl group, an alkoxycarbonyl group such as methoxycarbonyl group and methoxyethoxycarbonyl group, a sulfamoyl group such as dimethylsulfamoyl group, a sulfinamoyl group such as methylsulfinamoyl group, an alkoxysulfonyl group such as methoxysulfonyl group, a thioacyl group such as methylthiocarbonyl group, a thiocarbamoyl group such as methylcarbamoyl group, an oxaryl group or a heterocyclic group such as a pyridine ring or a pyridinium ring. B may form

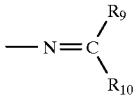

together with $A_2$ and the nitrogen atom liked to $A_2$. $R_9$ is an alkyl group, an aryl group or a heterocyclic group, and $R_{10}$ is a hydrogen atom, an alkyl group, an aryl group or a heterocyclic group. An acyl group and an oxaryl group are preferred as B.

Both of $A_1$ and $A_2$ in Formula H are hydrogen atoms, or one of them is a hydrogen atom and the other is an acyl group, such as acetyl group, trifluoroacetyl group and benzoyl group a sulfonyl group such as methanesulfonyl group and toluenesulfonyl group or an oxaryl group such as ethoxaryl group.

Among the hydrazine compounds usable in the invention, a hydrazine compound represented by the following Formula Ha is preferred.

Formula Ha

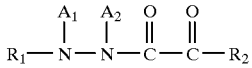

In Formula Ha, $R_1$ is an aryl group or a heterocyclic group, $R_2$ is an

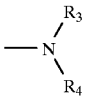

group or an —$OR_5$ group. $R_3$ and $R_4$ are each a hydrogen atom an alkyl group, an alkenyl group, an alkinyl group, an aryl group, a heterocyclic group, an amino group, a hydroxyl group, an alkoxyl group, an alkenyloxy group, an alkinyloxy group, an aryloxy group or a heterocyclic oxy group, and $R_3$ and $R_4$ may be linked together with the nitrogen atom to form a ring. $R_5$ is a hydrogen atom, an alkenyl group, an alkinyl group, an aryl group or a heterocyclic group. $A_1$ and $A_2$ are synonyms for $A_1$ and $A_2$ in Formula H, respectively.

Formula Ha is described in detail below. As the aryl group represented by $R_1$ is preferably a single ring or condensed ring such as benzene ring or a naphthalene ring. The heterocyclic group represented by $R_1$ is preferably a single or condensed 5 or 6-member unsaturated heterocycle containing at least one of nitrogen, sulfur and oxygen, such as a pyridine ring, a quinoline ring, a pyrimidine ring, a thiophene ring, a furan ring, a thiazole ring and a benzothiazole ring. An substituted and unsubstituted aryl groups are preferable as the group represented by $R_1$. As the substituent, one similar to the substituent of A of Formula H. When a developing solution having a pH of not more than 11.2 is used to form a high contrast image, it is preferred that at least one of the substituent is a sulfonamide group. Although $A_1$ and $A_2$ are synonyms for $A_1$ and $A_2$ in Formula H, respectively, and it is most preferable that both of them are a hydrogen atom. $R_2$ is an

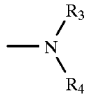

group or an —$OR_5$ group, in which $R_3$ and $R_4$ are each a hydrogen atom, an alkyl group such as methyl group, ethyl group and benzyl group, an alkenyl group such as allyl group and butenyl group, an alkinyl group such as propargyl group or bytinyl group, an aryl group such as phenyl group or naphthyl group, a heterocyclic group such as 2,2,6,6-tetramethylpiperidinyl group, N-benzylpiperidinyl group, quinolidinyl group, N,N'-diethylpyrazolidinyl group, N-benzylpyrrolidinyl group and pyridyl group, an amino group such as amino group, methylamino group, dimethylamino group and benzylamino group, a hydroxyl group, an alkoxyl group such as methoxy group and ethoxy group, an alkenyloxy group such as aryloxy group, an alkinyloxy group such as propargiloxy group, an aryloxy group such as phenoxy group, or a heterocyclic oxy group such as pyridyloxy group. $R_3$ and $R_4$ may form a ring such as piperidine or morpholine together with the nitrogen atom. $R_5$ is a hydrogen atom, an alkyl group such as methyl group, ethyl group, methoxyethyl group and hydroxyethyl group, an alkenyl group such as allyl group and butenyl group, an alkinyl group such as propargyl group and butinyl group, or a heterocyclic group such as 2,2,6,6-tetramethylpiperidinyl group, N-methylpiperydinyl group and pyridyl group.

Concrete examples of the hydrazine compound represented by Formula Ha are shown below. However, the invention is not limited thereto. Other than the followings, examples of the hydrazine compound represented by Formula Ha are described in JP O.P.I. No. 5-241264.

H-1

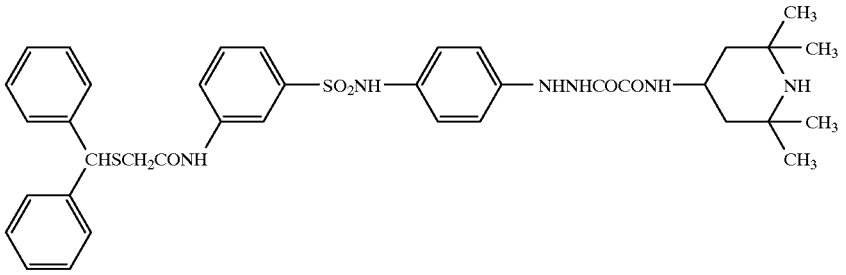

-continued

H-2

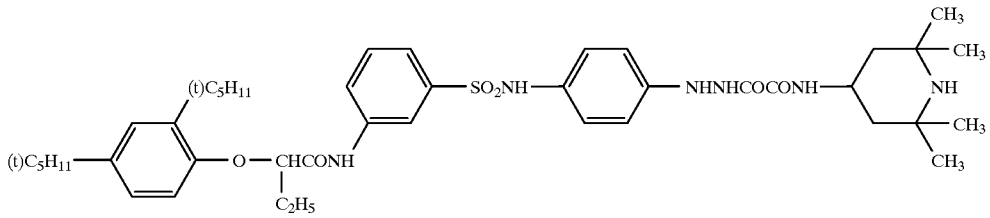

H-3

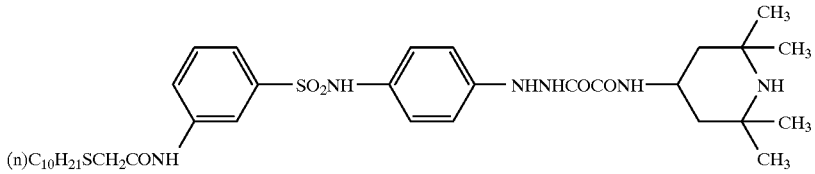

H-4

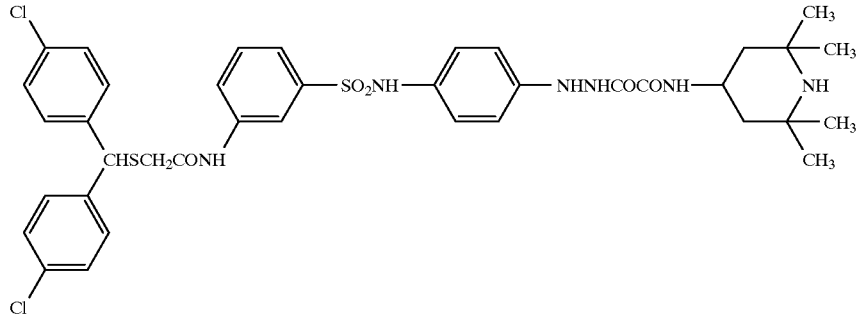

H-5

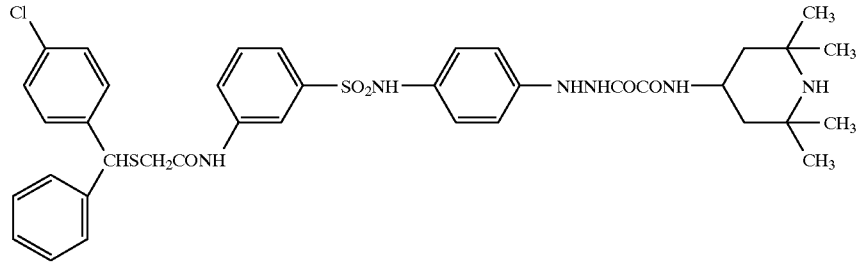

The hydrazine compound represented by Formula H can be synthesized referring the methods described in JP O.P.I. Nos. 62-180361, 62-178246, 63-234245, 63-234246, 64-90439, 2-37, 2-841, 2-947, 2-120736, 2-230233, and 3-125134, U.S. Pat. Nos. 4,686,167, 4,988,604, and 4,994,365 and European Patent Nos. 253,665 and 333,435.

The using amount of the hydrazine compound represented by Formula H of the invention is preferably from $5\times10^{-7}$ to $5\times10^{-1}$ moles, more preferably from $5\times10^{-6}$ to $5\times10^{-2}$ moles per mole of silver halide.

In the invention, the hydrazine compound represented by Formula H is added to a silver halide emulsion layer or a hydrophilic colloid layer adjoined to the emulsion layer.

The silver halide of the black-and-white light-sensitive material to be processed is preferably silver chlorobromide or silver chloroiodobromide each having a silver chloride content of 60 mole-% from the viewpoint of reducing in the replenishing rate and the suitability for rapid processing.

The average diameter of silver halide grains is preferably not more than 1.2 $\mu$m, more preferably from 0.1 to 0.8 $\mu$m. A monodisperse emulsion having a narrow grain diameter distribution is useful. An emulsion composed of a tabular grain having (100) face as the major face is preferred. Such the emulsion can be prepared by referring U.S. Pat. Nos. 5,264,337, 5,314,798 and 5,320,958. Moreover, it is preferable to dope iridium in an amount of from $10^{-9}$ to $10^{-3}$ moles per mole of silver halide for improving the high-intensity reciprocity raw failure, and to dope at least one of rhodium, ruthenium, osmium and rhenium in an amount of from $10^{-9}$ to $10^{-3}$ moles per mole of silver halide for raising contrast.

The silver halide emulsion may be subjected to a known chemical sensitization such as a sulfur sensitization, selenium sensitization, tellurium sensitization, reducing sensitization and a noble metal sensitization.

Techniques described in the following publications are preferably applied to the black-and-white light-sensitive material to be processed according to the invention.

1) Dispersion of fine solid particle of dye:
   JP O.P.I. No. 7-5629, page (3), paragraph [0017] to page (16), paragraph [0042]
2) Compound having an acidic group:
   JP O.P.I. No. 62-237445, page(8), line 11 in lower left column, to page 309(25), line 3 in lower right column
3) Acidic polymer:
   JP O.P.I. No. 6-186659, page (10), paragraph [0036] to page (17), paragraph 4) Sensitizing dye:

JP O.P.I. No. 5-224330, page (3), paragraph [0017] to page (13), paragraph JP O.P.I. No. 6-194771, page (11), paragraph [0042] to page (22), paragraph JP O.P.I. No. 6-242533, page (2), paragraph [0015] to page (8), paragraph JP O.P.I. No. 6-337492, page (3), paragraph [0012] to page (34), paragraph JP O.P.I. No. 6-337494, page (4), paragraph [0013] to page (14), paragraph 5) Super sensitizer:

JP O.P.I. No. 6-347938, page (3), paragraph [0011] to page (16), paragraph 6) Hydrazine derivative:

JP O.P.I. No. 7-114126, page (23), paragraph [0111] to page (32), paragraph 7) Nucleation accelerating agent:

JP O.P.I. No. 7-114126, page (32), paragraph [0158] to page (36), paragraph 8) Tetrazolium compound:

JP O.P.I. No. 6-208188, page (8), paragraph [0056] to page (10), paragraph 9) Pyridinium compound JP O.P.I. No. 7-110556, page (5), paragraph [0028] to page (29), paragraph 10) Redox compound:

JP O.P.I. No. 4-245243, page 253(7), to page 250(22)

11) Syndiotactic polystyrene support:

JP O.P.I. No. 3-131843, page 324(2), to page 327(5)

Moreover, additives described in Research Disclosure No. 17643, December 1978, No. 18716, November 1979, and No. 308119, December 1989, are useful.

EXAMPLES

Example 1

A black-and-white silver halide photographic light-sensitive material was prepared by the following receipts. The light-sensitive material was exposed to light so that 50% of the area of the light-sensitive material was blackened after processing, and processed by an automatic processor GR-26SR, manufactured by Konica Corporation, which is modified so as to be suitable for monobath processing and has a developing-fixing tank with a volume of: 35 liters. The processing composition according to the following receipt was used for processing and the replenishing rate was as follows. The light-sensitive material was processed in a rate of 200 sheets per day and the processing was run for 20 days. The size of the light-sensitive material was 508 mm×610 mm.

Preparation of Light-Sensitive Material

Preparation of Silver Halide Emulsion A

Silver chlorobromide core grains were prepared by a double-jet method which are composed of 70 mole-% of silver chloride and the remainder of silver bromide, and have an average thickness of 0.05 $\mu$m, and an average diameter of 0.15 $\mu$m. At the formation of the core grains, $8\times10^{-8}$ moles per mole of silver of $K_3RuCl_6$ was added. A shell was formed on each of the core grain by a double-jet method. At this time, $3\times10^{-7}$ moles per mole of silver of $K_2IrCl_6$ was added. Thus obtained emulsion is an emulsion comprises monodisperse silver chloroiodobromide tabular grains having an average thickness of 0.10 $\mu$m, an average diameter of 0.25 $\mu$m and a variation coefficient of 10% and (100) face as the major face. The grains were composed of 90 mole-% of silver chloride, 0.2 mole-% of silver iodide and the remainder of silver bromide.

The emulsion was cooled by 40° C., and 1,800 ml of a 13.8 weight-% solution of gelatin modified by phenylcarbamoyl group with substitution ratio of 90% was added to the emulsion as a high molecular weight flocculating agent and mixed for 3 minutes. The pH of the emulsion was adjusted to 4.6 by the addition of 56 weight-% acetic acid solution. The emulsion was stirred for 3 minutes and stood for 20 minutes. Then the top clear liquid was removed by decantation.

After the decantation, 9.0 liters of distilled water of 40° C. was added and the top clear liquid was removed after stirring and standing. Furthermore, 11.25 liters distilled water was added and the top clear liquid was removed after stirring and standing. A gelatin solution and a 10 weight-% solution of sodium carbonate were added to the remainder after the decantation so that the pH value was adjusted to 5.80. Then the solution was stirred for 30 minutes at 50° C. to redisperse the flocculated emulsion. The pH and pAg of the redispersed emulsion were adjusted 5.80 and 8.06, respectively, at 40° C. The $E_{Ag}$ of the emulsion was 190 mV at 50° C.

To thus obtained emulsion, $1\times10^{-3}$ moles per mole of silver of 4-hydroxy-6-methyl-1,3,3a,7-tetrazaindene was added and the pH and $E_{Ag}$ of the emulsion were adjusted to 5.6 and 123 mV, respectively, by potassium bromide and citric acid. Then $1\times10^{-3}$ mole per mole of silver of sodium p-toluenethiosulfate was added. The emulsion was chemically ripened at 60° C. so the maximum sensitivity is obtained, after addition of 350 mg of Chloramine T, 0.6 mg of elemental sulfur, S8, and 6 mg of trichloroaurate per mole of silver.

After ripening, $2\times10^{-3}$ moles per mole of silver of 4-hydroxy-6-methyl-1,3,3a,7-tetrazaindene and $3\times10^{-4}$ moles per mole of silver of 1-phenyl-5-mercaptotetrazole and 300 mg per mole of silver of potassium iodide were added to the emulsion.

Preparation of Silver Halide Emulsion B

Silver chloroiodobromide core grains composed of 60 mole-% of silver chloride, 2.5 mole-% of silver iodide and the remainder of silver bromide, having an average thickness of 0.05 $\mu$m and an average diameter of 0.15 $\mu$m, were prepare by a double-jet method. At the formation of the core grains, $2\times10^{-8}$ moles per mole silver of $K_3Rh(H_2O)Br_5$ was added. A shell was formed on each of the core grain by a double-jet method. At this time, $3\times10^{-7}$ moles per mole of silver of $K_2IrCl_6$ was added. Thus obtained emulsion is an emulsion comprises core/shell type monodisperse silver chloroiodobromide tabular grains having an average thickness of 0.10 $\mu$m, an average diameter of 0.42 $\mu$m, a variation coefficient of 10%, and a (100) face as the major face. The grains were composed of 90 mole-% of silver chloride, 0.5 mole-% of silver iodide and remainder of silver bromide. The emulsion was desalted by using a modified gelatin the same as that used in Emulsion A. The $E_{Ag}$ of the emulsion after desalting was 190 mV.

To thus obtained emulsion, $1\times10^{-3}$ moles per mole of silver of 4-hydroxy-6-methyl-1,3,3a,7-tetrazaindene was added and the pH and $E_{Ag}$ of the emulsion were adjusted to 5.6 and 123 mV, respectively, by potassium bromide and citric acid. Then $2\times10^{-5}$ moles of chloroauric acid and $3\times10^{-5}$ moles of N,N,N'-trimethyl-N'-heptafuluoroselenourea were added. The emulsion was chemically ripened at 60° C. so the maximum sensitivity is obtained. After ripening, $2\times10^{-3}$ moles per mole of silver of 4-hydroxy-6-methyl-1,3,3a,7-tetrazaindene, $3\times10^{-4}$ moles per mole of silver of 1-phenyl-5-mercaptotetrazole and gelatin were added to the emulsion.

Preparation of a Silver Halide Photographic Light-Sensitive Material for Photomechanical Scanner having a He-Ne Laser Light Source On the surface of subbing layer provided on a side of a support, the following layers were simultaneously coated in the following order from the support: a gelatin undercoating layer according to Receipt 1 having a coated amount of gelatin of 0.5 g/m$^2$, silver halide emulsion layer 1 according to Receipt 2 having coated amounts of silver and gelatin of 1.5 g/m$^2$ and 0.5 g/m$^2$, respectively, an interprotective layer according to Receipt 3 having a coated amount of gelatin of 0.3 g/m$^2$, silver halide emulsion layer 3 according to Receipt 4 having coated amounts of silver and gelatin of 1.4 g/m$^2$ and 0.4 g/m$^2$, respectively, and a layer according to Receipt 5 having a coated amount of gelatin of 0.6 g/m$^2$. On the subbing layer of the other side of the support, the following layers were simultaneously coated with layer on the emulsion side in the following order from the support: a backing layer having a coated amount of gelatin of 0.6 g/m$^2$, a hydrophilic polymer layer according to Receipt 7, and a backing protective layer having a coated amount of gelatin of 0.4 g/m$^2$.

| Receipt 1 (Gelatin undercoating layer) | |
|---|---|
| Gelatin | 0.5 g/m$^2$ |
| Solid particle dispersion of Dye AD-1 (average size: 0.1 μm) | 25 mg/m$^2$ |
| Sodium polystyrenesulfonate | 10 mg/m$^2$ |
| S-1 (sodium-iso-amyl-n-decylsulfosuccinate) | 0.4 mg/m$^2$ |
| **Receipt 2 (Silver halide emulsion layer 1)** | |
| Silver halide emulsion A | 1.5 g/m$^2$ in terms of silver |
| Solid particle dispersion of Dye AD-8 (average size: 0.1 μm) | 20 mg/m$^2$ |
| Cyclodexrin (Hydrophilic polymer) | 0.5 g/m$^2$ |
| Sensitizing dye d-1 | 5 mg/m$^2$ |
| Sensitizing dye d-2 | 5 mg/m$^2$ |
| Hydrazine compound of Formula H | Show table 1 |
| Nucleation accelerating agent: MA-1 | 40 mg/m$^2$ |
| Redox compound RE-1 | 20 mg/m$^2$ |
| Compound e | 100 mg/m$^2$ |
| Latex polymer f | 0.5 g/m$^2$ |
| Hardener g | 5 mg/m$^2$ |
| S-1 | 0.7 mg/m$^2$ |
| 2-mercapto-6-hydroxyprin | 5 mg/m$^2$ |
| EDTA | 30 mg/m$^2$ |
| Colloidal silica (average size: 0.05 μm) | 10 mg/m$^2$ |
| **Receipt 3 (Interlayer)** | |
| Gelatin | 0.3 g/m$^2$ |
| S-1 | 2 mg/m$^2$ |
| **Receipt 4 (Silver halide emulsion layer 2)** | |
| Silver halide emulsion B | 1.4 g/m$^2$ in terms of silver |
| Sensitizing dye d-1 | 3 mg/m$^2$ |
| Sensitizing dye d-2 | 3 mg/m$^2$ |
| Hydrazine compound of Formula H | Show Table 1 |
| Nucleation accelerating agent: MA-1 | 40 mg/m$^2$ |
| Redox compound RE-1 | 20 mg/m$^2$ |
| 2-mercapto-6-hydroxyprin | 5 mg/m$^2$ |

-continued

| | |
|---|---|
| EDTA | 20 mg/m$^2$ |
| Latex polymer f | 0.5 g/m$^2$ |
| S-1 | 1.7 mg/m$^2$ |
| **Receipt 5 (Emulsion protective layer)** | |
| Gelatin | 0.6 g/m$^2$ |
| Solid particle dispersion of dye b (average size: 0.1 μm) | 40 mg/m$^2$ |
| S-1 | 12 mg/m$^2$ |
| Matting agent: monodispersed silica (average size of 3.5 μm) | 25 mg/m$^2$ |
| 1,3-vinylsulfonyl-2-propanol | 40 mg/m$^2$ |
| Surfactant h | 1 mg/m$^2$ |
| Colloidal silica (average size: 0.05 μm) | 10 mg/m$^2$ |
| Hardener j | 30 mg/m$^2$ |
| **Receipt 6 (Backing layer)** | |
| Gelatin | 0.6 g/m$^2$ |
| S-1 | 5 mg/m$^2$ |
| Latex polymer f | 0.3 g/m$^2$ |
| Colloidal silica (average size: 0.05 μm) | 70 mg/m$^2$ |
| Sodium polystyrenesulfonate | 20 mg/m$^2$ |
| Compound I | 100 mg/m$^2$ |
| **Receipt 7 (Hydrophilic polymer layer)** | |
| Latex (methyl methacrylate:acrylic acid = 97:3) | 1.0 g/m$^2$ |
| Hardener g | 6 mg/m$^2$ |
| **Receipt 8 (Backing protective layer)** | |
| Gelatin | 0.4 g/m$^2$ |
| Matting agent: monodisperse polymethyl methacrylate having an average size of 5 μm | 50 mg/m$^2$ |
| Sodium di-(ethylhexyl)sulfosuccinate | 10 mg/m$^2$ |
| Surfactant h | 1 mg/m$^2$ |
| Dye k | 20 mg/m$^2$ |
| H—$(OCH_2CH_2)_{68}$—OH | 50 mg/m$^2$ |
| Hardener j | 20 mg/m$^2$ |

The compounds used were shown below.

Dye AD-1

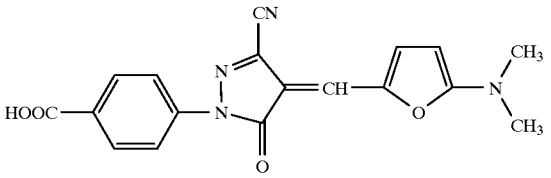

S-1

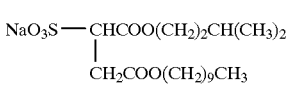

-continued
Dye AD-8
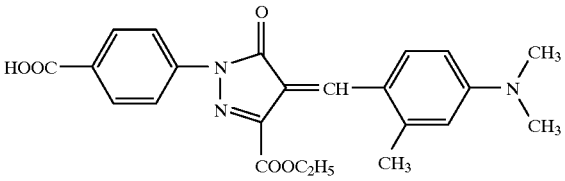
Sensitizing dye d-1
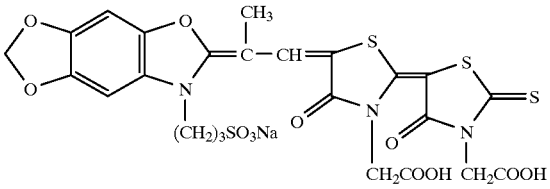
Sensitizing dye d-2
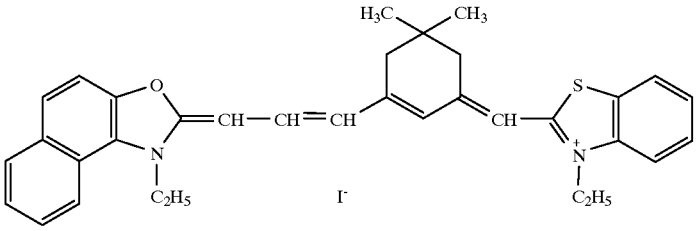
Nucleation accelerating agent AM-1
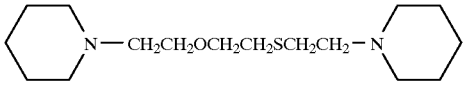
Redox compound RE-1
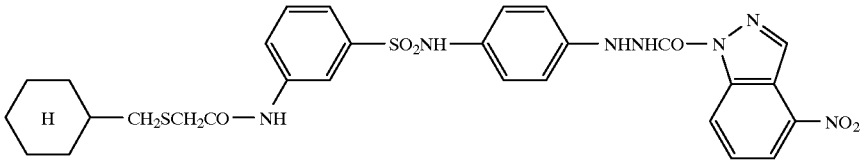
Compound e
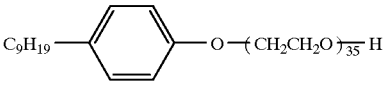
Polymer latex f
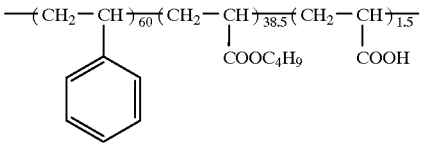
Hardener g
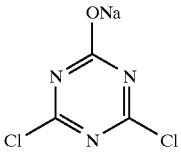
Dye b
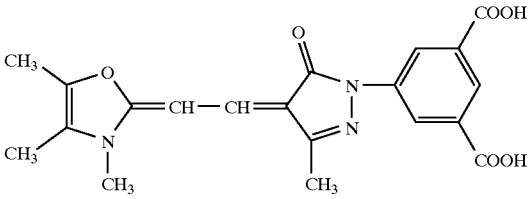
Surfactant h
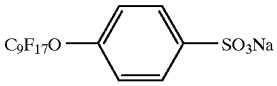
Hardener j
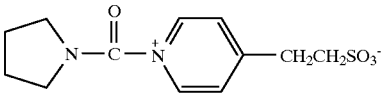
Compound i
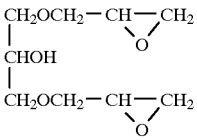
Dye k
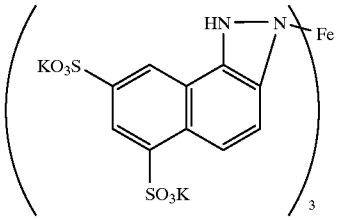

Preparation of Solid Monobath Processing Composition

Preparation of Granule A (for 1 Liter)

| | |
|---|---|
| Sodium sulfite | 25 g |
| Sodium carbonate | 11.2 g |
| 1-phenyl-1-4-hydroxyethyl-4-methyl-3-pyrazolidone | 0.7 g |
| KBr | 2 g |
| Pentasodium diethylenetriaminepentaacetate | 3 g |
| Benzotriazole | 0.26 g |
| Compound of Formula A | Shown in Table 1 |
| Hydroquinone | Shown in Table 1 |
| Mannitol | 10 g |

The above-mentioned materials were sufficiently crushed for 3 minutes in a stirring granulation apparatus available on the market. Then 5% by weight of water was gradually added. Thus obtained granules were moved in to a fluid layer dryer and dried for 2 hours by air of 60° C. Thus obtained granules were classified to 5 mm mesh through a sieving machine available on the market.

Preparation of Granule B (for 1 Liter)

| | |
|---|---|
| Sodium sulfite | 15 g |
| Sodium carbonate | 10 g |
| Ammonium thiosulfate | 56.8 g |
| Sodium acetate | 18.5 g |
| Mannitol | 10 g |
| Powdered sorbitol | 5 g |

The above-mentioned materials were sufficiently crushed for 3 minutes in a stirring granulation apparatus available on the market. Then 5% by weight of water was gradually added. Thus obtained granules were moved in to a fluid layer dryer and dried for 2 hours by air of 60° C. Thus obtained granules were classified to 5 mm mesh through a sieving machine available on the market.

The foregoing granules A and B each in an amount for 5 liters of solution were put into a fluidized layer granulation apparatus GPCG-5, manufactured by Paulex Co., Ltd., and fluidized by air of 60° C. with flow of 8 $m^3$/minute. A 30% solution of sorbitol in an amount of 20 g per granules for 1 liter solution was sprayed by a two-fluid nozzle for coating the surface of each of the granules. Thus surface coated granules are each referred to granules a and b, respectively.

To the foregoing two kinds of granules a and b each in an amount of for 15 liters of solution, sodium 1-octanesulfonate was added in an amount of 20% of the total weight of the granules. The mixture was mixed for 10 minutes in a cross rotary mixer. Thus obtained mixture was tableted in a rate of 10 g per tablet by an oil press machine. The tablet has a diameter of 30 mm and the tableting pressure was 1 metric ton/$cm^2$.

Samples of tableted processing compositions No. 8 to 20 were prepared in the above-mentioned manner except that the kind and amount of compound represented by Formula A were changed as shown in Table 1.

Furthermore, tabletted processing compositions No. 1, 3, 5, 6, and 7 without coating were prepared as comparative processing compositions. The kind and the amount of he compound represented by Formula A contained in these comparative samples are shown in table 1.

Using each of thus obtained tableted processing compositions, 35 liters of a monobath developing-fixing solution was prepared, respectively. The solution was used as the mother liquid of the processing solution.

On the other hand, processing solutions No. 2 and 4 were prepared by dissolving the materials used in the granules A and B in usual manner, for comparison.

The light-sensitive material samples were processed by the following processing composition and evaluated. In the light-sensitive material samples, the kind and amount of the compound represented by Formula H were changed as shown in Table 1.

TABLE 1

| | | Processing composition | | | | | Light-sensitive material | | | | |
|---|---|---|---|---|---|---|---|---|---|---|---|
| | | | | | | | Compound of Formula H in Emulsion layer 1 | | Compound of Formula H in Emulsion layer 2 | | |
| Test No. | Form of composition | Compound of Formula A No. | Compound of Formula A Amount (g) | HQ Amount (g) | Molar ratio of HQ/A | Coating | No. | Amount ($mg/m^2$) | No. | Amount ($mg/m^2$) | Note |
| 1 | Solid | None | — | 24 | — | None | H1 | 20 | H1 | 20 | Comp. |
| 2 | Liquid | A44 | 0.03 | 24 | $1.4 \times 10^3$ | — | H5 | 20 | H3 | 20 | Comp. |
| 3 | Solid | A29 | 0.03 | 24 | $1.3 \times 10^3$ | None | H2 | 20 | H2 | 20 | Comp. |
| 4 | Liquid | A29 | 0.03 | 24 | $1.3 \times 10^3$ | — | H3 | 15 | H4 | 15 | Comp. |
| 5 | Solid | A29 | 0.06 | 24 | $7.2 \times 10^2$ | None | H2 | 15 | H4 | 15 | Comp. |
| 6 | Solid | A44 | 0.6 | 24 | $6.4 \times 10$ | None | H3 | 15 | H2 | 15 | Comp. |
| 7 | Solid | A29 | 6 | 24 | 7.2 | None | H5 | 15 | H3 | 15 | Comp. |
| 8 | Solid | A29 | 0.06 | 24 | $6.4 \times 10^2$ | With | H4 | 10 | H1 | 20 | Inv. |
| 9 | Solid | A44 | 0.06 | 24 | $7.2 \times 10^2$ | With | H3 | 10 | H3 | 20 | Inv. |
| 10 | Solid | A29 | 60 | 0 | 0 | With | H2 | 10 | H1 | 20 | Inv. |
| 11 | Solid | A44 | 0.6 | 24 | $7.2 \times 10$ | With | H1 | 10 | H3 | 20 | Inv. |
| 12 | Solid | A44 | 6 | 24 | 7.2 | With | H5 | 20 | H5 | 20 | Inv. |
| 13 | Solid | A44 | 6 | 24 | 7.2 | With | H4 | 20 | H4 | 20 | Inv. |
| 14 | Solid | A44 | 6 | 20 | 7.2 | With | H4 | 20 | H5 | 20 | Inv. |
| 15 | Solid | A29 | 6 | 24 | 6.4 | With | H5 | 20 | H4 | 20 | Inv. |
| 16 | Solid | A13 | 6 | 20 | 26.1 | With | H4 | 15 | H3 | 15 | Inv. |
| 17 | Solid | A28 | 3 | 24 | 11.6 | With | H3 | 15 | H5 | 15 | Inv. |
| 18 | Solid | A34 | 10 | 24 | 4.2 | With | H1 | 10 | H4 | 10 | Inv. |
| 19 | Solid | A38 | 8 | 20 | 19.9 | With | H5 | 10 | H3 | 10 | Inv. |
| 20 | Solid | A52 | 6 | 16 | 5.2 | With | H2 | 10 | H2 | 10 | Inv. |

Granules A and B were each subjected to the following coating procedure.

The processing was carried out under the following condition.

Processing Condition

| | Temperature | Time |
|---|---|---|
| Developing-fixing | 35° C. | 25 seconds |
| Washing | 35° C. | 20 seconds |
| Drying | 48° C. | 20 seconds |

Evaluation of the combination of processing composition and light-sensitive material was performed as follows:

Evaluation of Linearity and Dot Quality

Each of the foregoing samples of light-sensitive material was exposed to light through an 8 μm random pattern half tone screen, manufactured by Dainihon Screen Co., Ltd., and processed under the above-mentioned conditions. The quality or sharpness of dot was visually evaluated through a loupe having a magnification of 100 with respect to the dots having a dot are of about 50%. The dot quality of the sample was classified into five ranks, in which the highest rank is 5 and the rank is lowered 4 to 1 according to lowering of the dot quality. The dot quality ranked as 1 or 2 is a level of dot quality unacceptable for practical use. The linearity is evaluated by measuring the dot-% of a dot which has to be theoretically 95% when the sample is exposed to light so that a dot to be 2 dot-% is correctly reproduced to 2 dot-%. It is preferably that the measured value is near 95%. Densitometer X-Rite 316T, manufacture by X-Rite Incorporated, was used for measurement.

The Maximum Density in Practical Use

The maximum density formed on the sample when the sample was exposed to light so that an original having a 50%-image is reproduced as 50%-dot image on the sample, was measured.

Evaluation of Fog

The density of unexposed area of the processed sample was measured by X-Rite 316T. The fog density not more than 0.025 is preferred.

Formation of Sludge in Developing Tank

The degree of sludge formation in the developing tank after running of the processing was visually evaluated and classified into the following five ranks.

A: No precipitation was observed at all, and the processing solution was clear.

B: No precipitation was observed.

C: No precipitation was observed but the solution was turbid. Acceptable for practical use.

D: Precipitation was observed a little.

E: Precipitation was accumulated on the bottom of the tank.

The degree of sludge formation ranked C or higher is acceptable for practical use.

Moreover, the storage ability of the processing composition was evaluated in the following manner:

Each of the tabletted processing compositions was sealed in an amount for 1 liter of solution in a container made by aluminum laminated with a polyethylene film and incubated for 2 weeks at 50° C. The foregoing experiments were repeated using the examples of processing composition after the incubation. Furthermore, the following evaluation on the appearance of the processing composition after storage was performed by visual observation. The change in the appearance of the compositions were classified into the following four ranks.

A: No change was observed compare to the appearance before the storage.

B: Although the shape of tablet was not changed, the color was changed slightly.

C: The shape of tablet was changed a little and the color was slightly changed.

D: The shape of tablet was considerably changed and the color was also change.

Ranks A and B are acceptable for practical use.

Thus obtained results are listed in the following Table 2.

TABLE 2

| | Before incubation | | | | | After incubation | | | | | | |
|---|---|---|---|---|---|---|---|---|---|---|---|---|
| Test No. | Dot quality | Linearity (%) | $D_{max}$ | Sludge | Fog | Dot quality | Linearity (%) | $D_{max}$ | Sludge | Appearance | Fog | Note |
| 1 | 2 | 71 | 4.3 | D | 0.028 | 1 | 65 | 3.8 | E | D | 0.033 | Comp. |
| 2 | 2 | 75 | 4.5 | E | 0.027 | 1 | 68 | 4.1 | E | — | 0.035 | Comp. |
| 3 | 2 | 85 | 4.3 | D | 0.032 | 1 | 70 | 3.9 | E | D | 0.040 | Comp. |
| 4 | 3 | 85 | 4.5 | C | 0.033 | 2 | 71 | 4 | E | — | 0.038 | Comp. |
| 5 | 3 | 88 | 4.5 | C | 0.028 | 2 | 71 | 4.1 | D | D | 0.032 | Comp. |
| 6 | 3 | 82 | 4.7 | D | 0.030 | 1 | 72 | 4.2 | D | D | 0.033 | Comp. |
| 7 | 3 | 77 | 4.7 | C | 0.027 | 1 | 75 | 4.3 | D | D | 0.034 | Comp. |
| 8 | 4 | 93 | 5.6 | A | 0.019 | 4 | 93 | 5.5 | B | A | 0.020 | Inv. |
| 9 | 4 | 93 | 5.5 | B | 0.018 | 4 | 93 | 5.4 | B | A | 0.021 | Inv. |
| 10 | 5 | 94 | 5.5 | A | 0.019 | 4 | 92 | 5.4 | B | A | 0.020 | Inv. |
| 11 | 5 | 94 | 5.3 | B | 0.017 | 4 | 93 | 5.3 | B | A | 0.020 | Inv. |
| 12 | 5 | 95 | 6.0 | A | 0.016 | 5 | 95 | 6 | A | A | 0.016 | Inv. |
| 13 | 5 | 95 | 6.2 | A | 0.016 | 5 | 95 | 6.2 | A | A | 0.016 | Inv. |
| 14 | 5 | 95 | 6.3 | A | 0.016 | 5 | 95 | 6.3 | A | A | 0.017 | Inv. |
| 15 | 5 | 95 | 6.1 | A | 0.016 | 5 | 95 | 6.1 | A | A | 0.017 | Inv. |
| 16 | 5 | 96 | 5.8 | A | 0.018 | 4 | 94 | 5.7 | A | A | 0.019 | Inv. |
| 17 | 4 | 95 | 5.9 | A | 0.017 | 4 | 94 | 5.8 | B | A | 0.018 | Inv. |
| 18 | 5 | 95 | 5.7 | A | 0.018 | 4 | 94 | 5.7 | A | A | 0.019 | Inv. |
| 19 | 5 | 94 | 5.8 | A | 0.018 | 5 | 93 | 5.7 | B | A | 0.018 | Inv. |
| 20 | 5 | 94 | 5.8 | A | 0.018 | 5 | 93 | 5.7 | A | A | 0.018 | Inv. |

In the comparative examples, it is considered that a bad influence is given of the processed samples as shown in Table 2. On the other hand, good results satisfying the requirements of the practical use are obtained in the examples of the invention.

What is claimed is:

1. A method for processing a black-and-white silver halide photographic light-sensitive material comprising the steps of providing a solid composition which comprises a first partial composition containing a developing agent represented by Formula A and optionally a dihydroxybenzene compound, and a second partial composition containing a fixing agent, and both of the first and the second partial composition are each coated with a coating material, dissolving the solid composition into water in order to make a monobath processing solution, processing a silver halide photographic light-sensitive material comprising a compound represented by Formula H with the monobath processing solution, Formula (A)

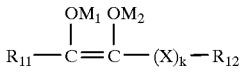

wherein, $R_{11}$ and $_{12}$ are each an alkyl group, an alkokyl group, an amino group, or an alkylthio group, and $R_{11}$ and $_{12}$ may be linked with each other to form a ring, k is 0 or 1, and X is —OC— or —CS when k is 1, and $M_1$ and $M_2$ are each a hydrogen atom or an alkali metal atom, Formula (H)

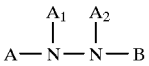

wherein, A is an aliphatic group, an aromatic group or a heterocyclic group, B is an acyl group, an alkylsulfonyl group, an arylsulfonyl group, an alkylsulfinyl group, an arylsulfinyl group, a carbamoyl group, an alkoxycarbonyl group, an aryloxycarbonyl group, a sulfamoyl group, a sulfinamoyl group, an alkoxysulfonyl group, thioacyl group, a thiocarbamoyl group, an oxaryl group, or a heterocyclic group, and $A_1$ and $A_2$ are each a hydrogen atom, or one of them is a hydrogen atom and the other one is a acyl group, a sulfonyl group or an oxaryl group.

2. The method of claim 1 wherein each of the first part and the second part of the solid processing composition is in a form of glanule.

3. The method of claim 2, wherein the first part and the second part each in the form of granules were mixed and pressed into a tablet.

4. The method of claim 1, wherein the coating material is a succharide or a water-soluble polymer.

5. The method of claim 1, wherein the molar ratio of the compound represented by Formula A to the dihydroxybenzene compound is from 0 to 1000.

6. The method of claim 1, wherein the compound represented by Formula A is a compound represented by Formula A-a Formula A-a

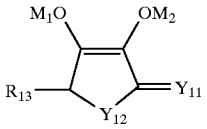

wherein $R_{13}$ is a hydrogen atom, an alkyl group, an aryl group, an amino group, an alkoxyl group, a sulfo group, a carboxyl group, an amido group or a sulfonamido group, $Y_{11}$ is O, S or $NR_{14}$. $R_{14}$ is an alkyl group or an aryl group.

* * * * *